US009236042B2

(12) United States Patent
Kuroda et al.

(10) Patent No.: US 9,236,042 B2
(45) Date of Patent: Jan. 12, 2016

(54) OSCILLATION DEVICE

(71) Applicants: Jun Kuroda, Kanagawa (JP); Yasuharu Onishi, Kanagawa (JP); Shigeo Satou, Kanagawa (JP); Motoyoshi Komoda, Kanagawa (JP)

(72) Inventors: Jun Kuroda, Kanagawa (JP); Yasuharu Onishi, Kanagawa (JP); Shigeo Satou, Kanagawa (JP); Motoyoshi Komoda, Kanagawa (JP)

(73) Assignee: NEC Corporation, Tokyo (JP)

( * ) Notice: Subject to any disclaimer, the term of this patent is extended or adjusted under 35 U.S.C. 154(b) by 37 days.

(21) Appl. No.: 14/362,692

(22) PCT Filed: Dec. 5, 2012

(86) PCT No.: PCT/JP2012/007811

§ 371 (c)(1),
(2) Date: Jun. 4, 2014

(87) PCT Pub. No.: WO2013/084491

PCT Pub. Date: Jun. 13, 2013

(65) Prior Publication Data

US 2014/0376335 A1 Dec. 25, 2014

(30) Foreign Application Priority Data

Dec. 7, 2011 (JP) ..... 2011-267826

(51) Int. Cl.

| | |
|---|---|
| ***G10K 11/18*** | (2006.01) |
| ***H04R 7/20*** | (2006.01) |
| *H04R 17/00* | (2006.01) |
| *H04R 7/04* | (2006.01) |
| *H04R 1/06* | (2006.01) |
| *H04R 7/22* | (2006.01) |

(52) U.S. Cl.

CPC *G10K 11/18* (2013.01); *H04R 7/20* (2013.01); *H04R 1/06* (2013.01); *H04R 7/04* (2013.01); *H04R 7/22* (2013.01); *H04R 17/00* (2013.01); *H04R 2217/03* (2013.01)

(58) Field of Classification Search

CPC ..... H04R 7/20; H04R 7/04; H04R 1/06; H04R 17/00; H04R 2217/03; H04R 7/22; G10K 11/18

See application file for complete search history.

(56) References Cited

U.S. PATENT DOCUMENTS

2014/0376335 A1* 12/2014 Kuroda ..... H04R 7/20 367/189

FOREIGN PATENT DOCUMENTS

JP 62-014897 U 1/1987
JP 64-5181 U 1/1989

(Continued)

OTHER PUBLICATIONS

International Search Report corresponding to PCT/JP2012/007811 dated Jan. 15, 2013 (5 pages).

*Primary Examiner* — Daniel Pihulic

(74) *Attorney, Agent, or Firm* — Wilmer Cutler Pickering Hale and Dorr LLP

(57) ABSTRACT

A vibration member (140) has a sheet shape. A piezoelectric element (130) is attached to one surface of the vibration member (140). A support member (110) supports the edge of the vibration member (140). The support member (110) includes a first facing portion (112) and a second facing portion (114). The first facing portion (112) faces the surface of the vibration member (140) to which the piezoelectric element (130) is attached. The second facing portion (114) faces the surface of the vibration member (140) which is located on the opposite side to the piezoelectric element (130). A first spring (152) is provided between the first facing portion (112) and the vibration member (140) or the piezoelectric element (130). A second spring (154) is provided between the second facing portion (114) and the vibration member (140).

8 Claims, 7 Drawing Sheets

(56) References Cited

FOREIGN PATENT DOCUMENTS

| | | | | | |
|---|---|---|---|---|---|
| JP | 03-124200 | A | | 5/1991 | |
| JP | 09-046793 | A | | 2/1997 | |
| JP | 3044460 | U | | 10/1997 | |
| JP | 2005-295339 | A | | 10/2005 | |
| JP | 2007-318997 | A | | 12/2007 | |
| JP | 2008-172458 | A | | 7/2008 | |
| JP | WO 2013084491 | A1 | * | 6/2013 | ..... H04R 7/20 |
| WO | WO-2011/074579 | A1 | | 6/2011 | |

* cited by examiner

OSCILLATION DEVICE

CROSS-REFERENCE TO RELATED APPLICATIONS

This application is a national stage application of International Application No. PCT/JP2012/007811 entitled "Oscillation Device," filed on Dec. 5, 2012, which claims the benefit of the priority of Japanese Patent Application No. 2011-267826, filed on Dec. 7, 2011, the disclosures of each of which are hereby incorporated by reference in their entirety.

TECHNICAL FIELD

The present invention relates to an oscillation device that oscillates a sonic wave.

BACKGROUND ART

There is a parametric speaker as one of speakers. For example, as disclosed in Patent Document 1, the parametric speaker modulates an audio signal into a modulation signal of an ultrasonic wave band, and demodulates the modulation signal into an audible sound in the atmosphere.

As an oscillation device that oscillates a sonic wave of an ultrasonic wave band, there is a device in which a piezoelectric element is used as a vibrator (for example, Patent Documents 1 to 4). When a piezoelectric element is used as a vibrator, it is necessary to form electrodes on both sides of the piezoelectric element, and to input a signal between the two electrodes. Patent Documents 1 and 2 of these Patent Documents disclose that a terminal for inputting a signal to the electrode located on the upper surface side of the piezoelectric element utilizes a spring.

Meanwhile, Patent Document 5 discloses that in a piezoelectric actuator, a piezoelectric element is supported by a power feeding support portion through an elastic body.

RELATED DOCUMENT

Patent Document

[Patent Document 1] Japanese Registered Utility Model No. 3044460

[Patent Document 2] Japanese Unexamined Patent Publication No. 2005-295339

[Patent Document 3] Japanese Unexamined Utility Model Registration Publication No. S62-14897

[Patent Document 4] Japanese Unexamined Patent Publication No. H09-46793

[Patent Document 5] Japanese Unexamined Patent Publication No. 2007-318997

DISCLOSURE OF THE INVENTION

In a structure disclosed in Patent Documents 1 and 2, a spring is connected to one surface of a vibrator. Since a force from the spring is applied to the surface of the piezoelectric element to which the spring is connected, the balance of stress which is applied to the piezoelectric element is impaired. In this case, the characteristics of the oscillation device deteriorate.

An object of the present invention is to provide an oscillation device capable of satisfactorily maintaining the balance of stress which is applied to a piezoelectric element.

According to the present invention, there is provided an oscillation device including: a sheet-like vibration member; a piezoelectric element which is attached to one surface of the vibration member; a support member that supports an edge of the vibration member; a first facing portion, provided in the support member, which faces the one surface of the vibration member; a second facing portion, provided in the support member, which faces a surface which is located on the opposite side to the one surface of the vibration member; a first spring which is provided between the vibration member or the piezoelectric element and the first facing portion; and a second spring which is provided between the vibration member and the second facing portion.

According to the present invention, it is possible to satisfactorily maintain the balance of stress which is applied to the vibration member and the piezoelectric element.

BRIEF DESCRIPTION OF THE DRAWINGS

The above-mentioned objects, other objects, features and advantages will be made clearer from the preferred exemplary embodiments described below, and the following accompanying drawings.

DESCRIPTION OF EMBODIMENTS

Figure 1:
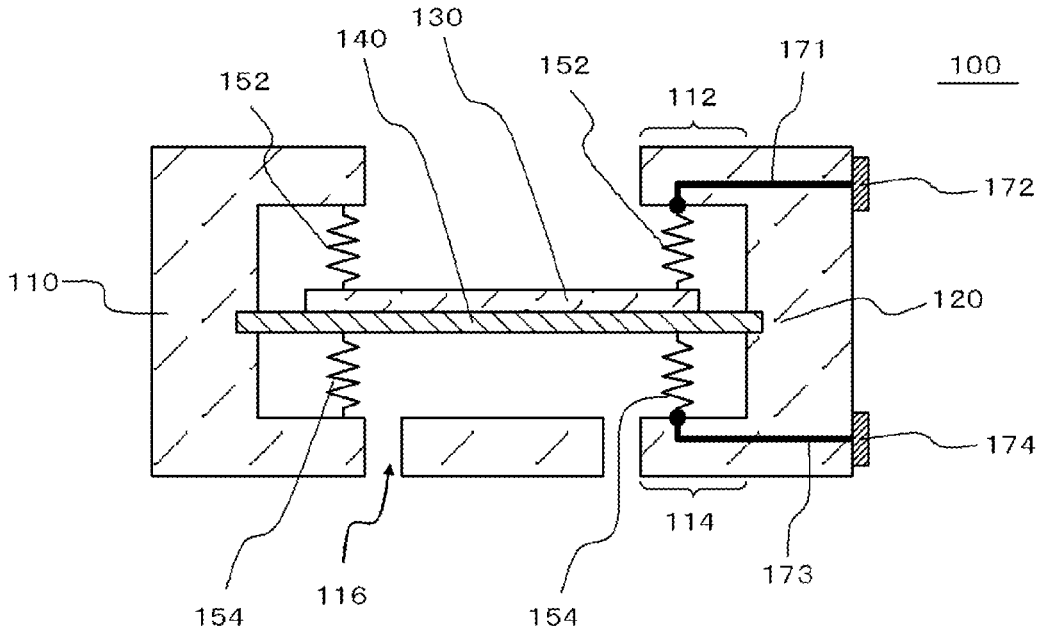
FIG. 1 is a diagram illustrating a configuration of an oscillation device according to a first embodiment.

Hereinafter, the embodiments of the present invention will be described with reference to the accompanying drawings. In all the drawings, like elements are referenced by like reference numerals and descriptions thereof will not be repeated.

First Embodiment

FIG. 1 is a diagram illustrating a configuration of an oscillation device 100 according to a first embodiment. The oscillation device 100 includes a vibration member 140, a piezoelectric element 130, a support member 110, first springs 152, and second springs 154. The vibration member 140 has a sheet shape. The piezoelectric element 130 is attached to one surface of the vibration member 140. The support member 110 supports the edge of the vibration member 140. The support member 110 includes a first facing portion 112 and a second facing portion 114. The first facing portion 112 faces the surface of the vibration member 140 to which the piezoelectric element 130 is attached. The second facing portion 114 faces the surface of the vibration member 140 which is located on the opposite side to the piezoelectric element 130. The first springs 152 are provided between the first facing portion 112 and the vibration member 140 or the piezoelectric element 130. The second springs 154 are provided between the second facing portion 114 and the vibration member 140. In this embodiment, the springs are attached onto both sides of a vibrator constituted by the vibration member 140 and the piezoelectric element 130. Therefore, it is possible to satisfactorily maintain the balance of stress which is applied to the vibrator. Hereinafter, a detailed description will be given.

The vibration member 140 has a sheet shape, and is vibrated by a vibration generated from the piezoelectric element 130. In addition, the vibration member 140 adjusts the fundamental resonance frequency of the piezoelectric element 130. It is preferable that the thickness of the vibration member 140 be equal to or greater than 5 μm and equal to or less than 500 μm. In addition, it is preferable that the vibration member 140 have a modulus of longitudinal elasticity which is an index indicating rigidity being equal to or greater than 1 GPa and equal to or less than 500 GPa. When the rigidity of the vibration member 140 is excessively low or excessively high, there is the possibility of the characteristics or reliability of a mechanical vibrator being damaged. Meanwhile, a material constituting the vibration member 140 is not particularly limited insofar as it is a material, such as a metal or a resin, having a high elastic modulus for the piezoelectric element 130 made of a brittle material, but it is preferable that the material be phosphor bronze, stainless steel or the like from the viewpoint of workability or cost.

The piezoelectric element 130 is formed of, for example, piezoelectric ceramics such as PZT. However, the piezoelectric element 130 may be formed of other piezoelectric materials. The planar shape of the piezoelectric element 130 is smaller than the planar shape of the vibration member 140.

A laminated body of the piezoelectric element 130 and the vibration member 140 is disposed so that the piezoelectric element 130 is turned toward the upper surface side of the support member 110. That is, the oscillation device 100 oscillates sonic waves on the upper surface side of the support member 110. In the present embodiment, the support member 110 includes a cylindrical lateral portion. The inner wall of the lateral portion supports the edge of the vibration member 140.

The bottom face of the support member 110 is blocked. For this reason, a closed space is formed by the vibration member 140 and the support member 110. The closed space is connected to the outside through a through-hole 116 formed on the bottom face of the support member 110. Meanwhile, a portion of the support member 110 in which the bottom face is blocked serves as the second facing portion 114.

In addition, the upper end of the lateral portion of the support member 110 overhangs to the inside. In the present embodiment, such an overhanging portion serves as the first facing portion 112. In addition, terminals 172 and 174 are provided on the outer surface of the lateral portion of the support member 110.

The first spring 152 is a coil spring, and is formed by a conductor made of a metal or the like. One end of the first spring 152 is attached to the first facing portion 112, and the other end thereof is attached to the piezoelectric element 130. One end of at least one first spring 152 is connected to a first interconnect 171. The first interconnect 171 connects the first spring 152 with the terminal 172. That is, in the present embodiment, a surface electrode of the piezoelectric element 130 is connected to the terminal 172 through the first spring 152 and the first interconnect 171.

The second spring 154 is a coil spring, and is formed by a conductor such as a metal or the like. One end of the second spring 154 is attached to the second facing portion 114, and the other end thereof is attached to the vibration member 140. In the example shown in this drawing, the vibration member 140 is formed by a conductor, and serves as a back electrode of the piezoelectric element 130 as well. One end of at least one second spring 154 is connected to a second interconnect 173. The second interconnect 173 connects the second spring 154 with the terminal 174. That is, in the present embodiment, the back side of the piezoelectric element 130 is connected to the terminal 174 through the vibration member 140, the second spring 154, and the second interconnect 173.

Meanwhile, a cone may be fixed onto the upper surface of the piezoelectric element 130 through an adhesive layer. This cone is made of, for example, a metal, and is provided in order to increase an amount of sonic waves which are output by the oscillation device 100.

Figure 2:
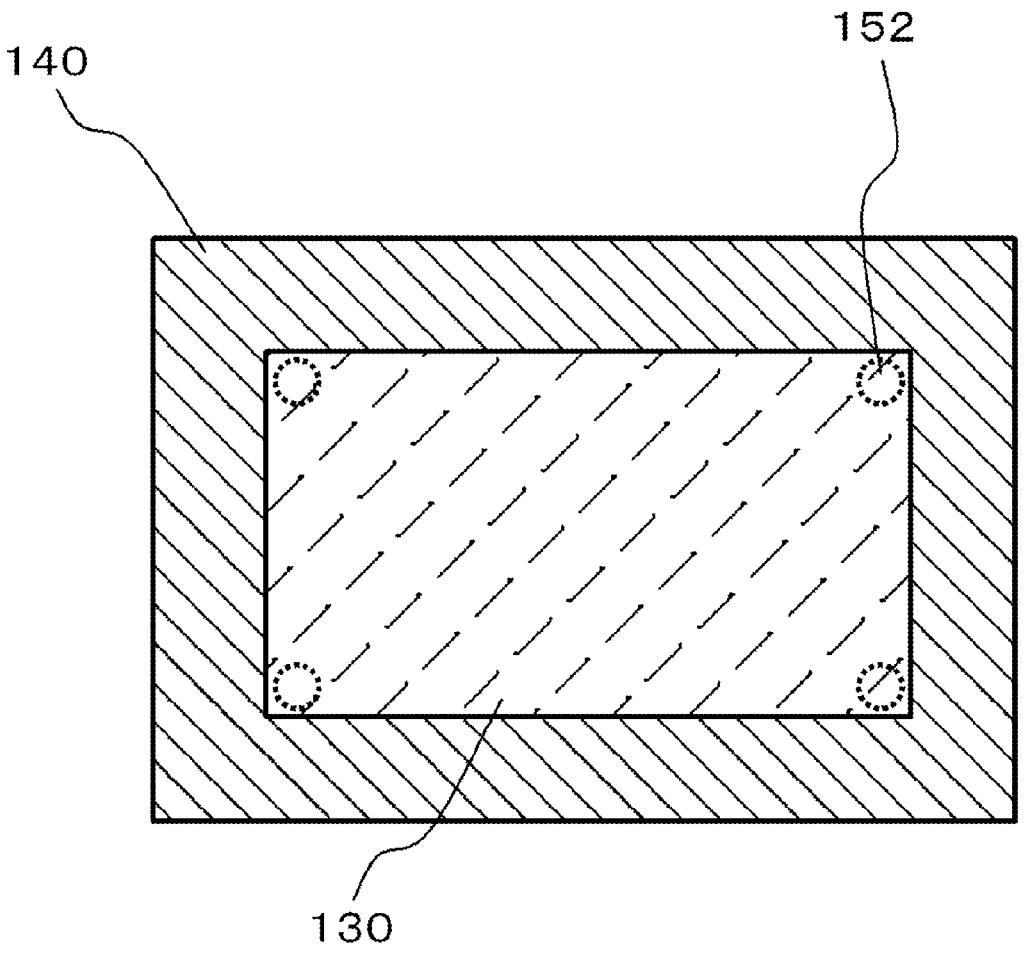
FIG. 2 is a plan view illustrating a layout of first springs.

FIG. 2 is a plan view illustrating a layout of the first springs 152. In the example shown in this drawing, both the piezoelectric element 130 and the vibration member 140 have a rectangular shape. Three or more first springs 152 are provided at positions which do not overlap each other. In the example shown in this drawing, the first springs 152 are respectively provided on four corners of the piezoelectric element 130.

Figure 3:
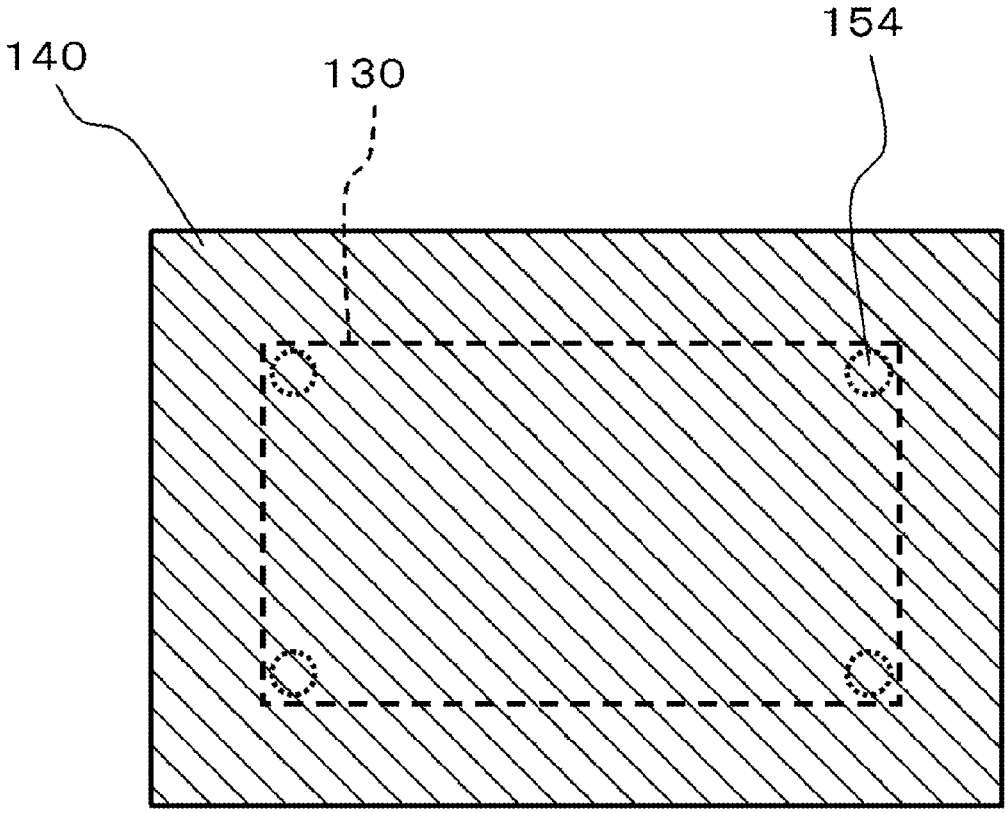
FIG. 3 is a plan view illustrating a layout of second springs.

FIG. 3 is a plan view illustrating a layout of the second springs 154. In the example shown in this drawing, three or more second springs 154 are provided at positions which do not overlap each other. In the example shown in this drawing, the second springs 154 are provided at positions overlapping the first springs 152 when seen in a plan view. Specifically, the second springs are respectively provided at positions overlapping the four corners of the piezoelectric element 130.

Figure 4:
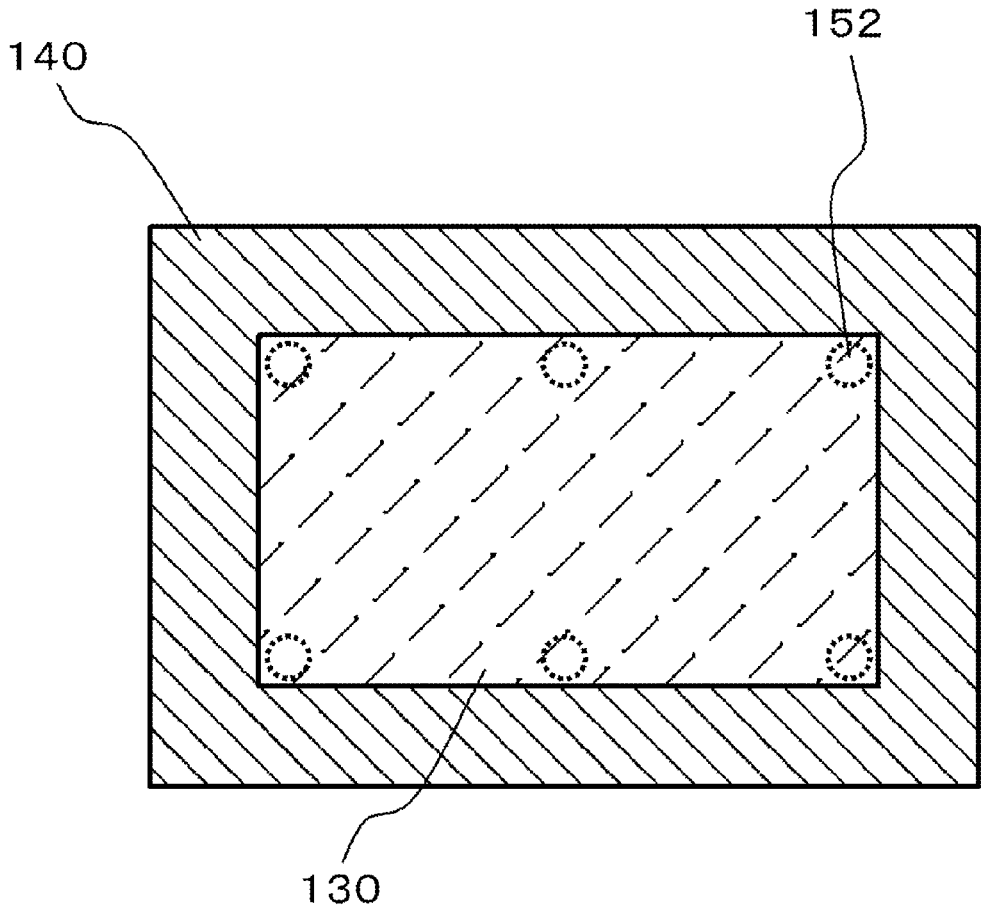
FIG. 4 is a diagram illustrating a modified example of FIG. 2.

Meanwhile, the layout of the first springs 152 and the second springs 154 is not limited to the examples shown in FIGS. 2 and 3. For example, as shown in FIG. 4, the first springs 152 may be further provided at portions corresponding to the center of the long side of the piezoelectric element 130, in addition to portions shown in FIG. 2. In this case, the second springs 154 are also provided additionally at positions overlapping the first springs 152 when seen in a plan view.

In addition, in the present embodiment, the spring constants of the first spring 152 and the second spring 154 are equal to each other. For example, the first spring 152 and the second spring 154 are coil springs which are the same as each other.

Meanwhile, the oscillation device 100 is used, for example, in a state of being arranged in a plurality of arrays. The oscillation device 100 is used as, for example, a parametric speaker. In this case, a modulation signal for a parametric speaker is input to the terminals 172 and 174 of the oscillation device 100. The modulation signal is generated, for example, by performing amplitude modulation (AM), double side band (DSB) modulation, single side band (SSB) modulation, or frequency modulation (FM) on an audio signal of an audible sound which is input from the outside.

As described above, according to the present embodiment, the springs are attached to both sides of the vibrator constituted by the vibration member 140 and the piezoelectric element 130. Therefore, it is possible to satisfactorily maintain the balance of stress which is applied to the vibrator. Such an effect increases particularly in a case where the first springs 152 and the second springs 154 overlap each other when seen in a plan view. In addition, such an effect increases particularly in a case where the spring constants of the first spring 152 and the second spring 154 are equal to each other.

In addition, three or more first springs 152 and three or more second springs 154 are provided. For this reason, as compared with a case where the number of first springs 152 and the number of second springs 154 are two or less, respectively, it is possible to suppress the trembling of a normal line of the vibrator constituted by the piezoelectric element 130 and the vibration member 140. Such an effect increases particularly in a case where the first springs 152 and the second springs 154 overlap each other when seen in a plan view. In addition, such an effect increases particularly in a case where the spring constants of the first spring 152 and the second spring 154 are equal to each other.

In addition, in the present embodiment, the first spring 152 and the second spring 154 serve as a portion of an interconnect for inputting a signal to the piezoelectric element 130. For this reason, even when the piezoelectric element 130 moves up and down due to a vibration, it is possible to suppress the deviation of the interconnect from the piezoelectric element 130.

In addition, the first spring 152 can be directly connected to the piezoelectric element 130. Therefore, the length of the interconnect connected to an upper surface electrode of the piezoelectric element 130 can be reduced. In addition, work efficiency is improved as compared with a case where a normal interconnect is connected to the piezoelectric element 130.

In addition, it is possible to regulate the natural frequency of the vibrator constituted by the piezoelectric element 130 and the vibration member 140 by regulating the spring constant of the first spring 152 and the second spring 154.

Second Embodiment

Figure 5:
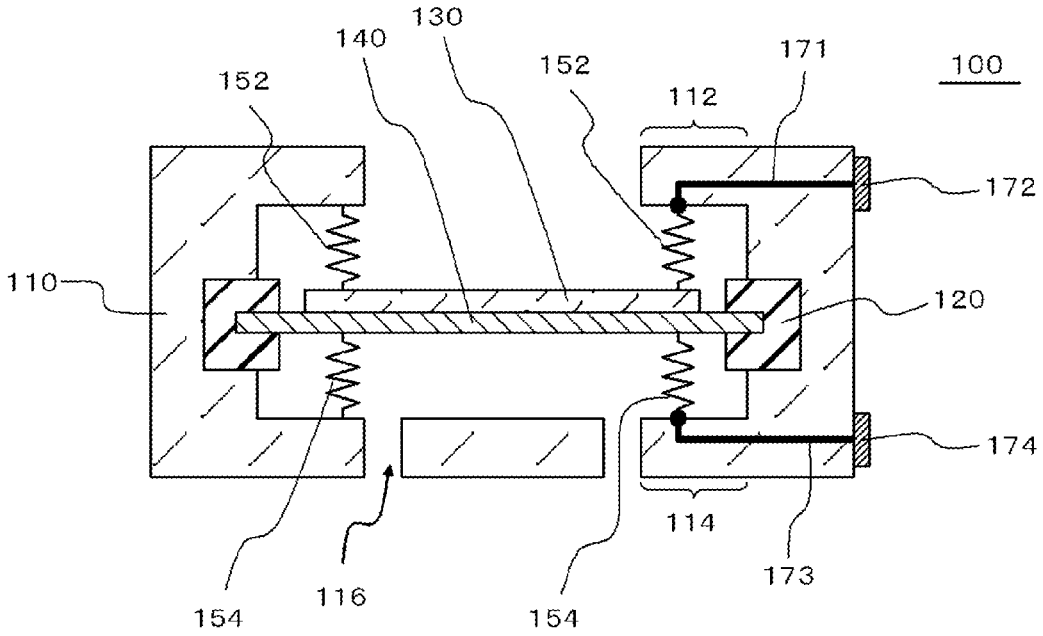
FIG. 5 is a diagram illustrating a configuration of an oscillation device according to a second embodiment.

FIG. 5 is a diagram illustrating a configuration of an oscillation device 100 according to a second embodiment. The present embodiment has the same configuration as that of the oscillation device 100 according to the first embodiment, except for the following points.

The piezoelectric element 130 and the vibration member 140 are supported by the support member 110 through an elastic material 120. Specifically, a concave portion is formed on the inner circumferential surface of the support member 110 throughout the circumference thereof, and the elastic material 120 is buried within the concave portion. The elastic material 120 is a material having an elasticity lower than that of the support member 110, for example, a resin. The edge of the vibration member 140 is buried in the elastic material 120.

In the present embodiment, it is also possible to obtain the same effect as that of the first embodiment. In addition, the edge of the vibration member 140 is held by the elastic material 120 having an elasticity lower than that of the support member 110. Therefore, the amplitude of the vibration member 140 increases.

Third Embodiment

Figure 6:
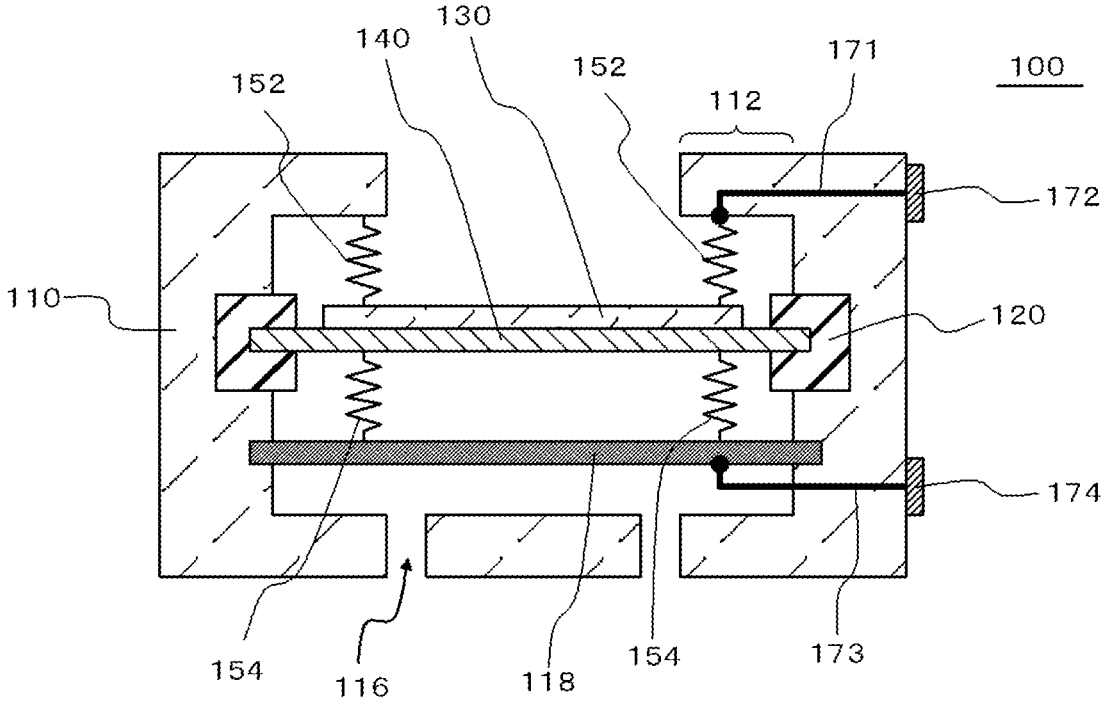
FIG. 6 is a diagram illustrating a configuration of an oscillation device according to a third embodiment.

FIG. 6 is a diagram illustrating a configuration of an oscillation device 100 according to a third embodiment. The oscillation device 100 according to the present embodiment has the same configuration as that of the oscillation device 100 according to the second embodiment, except that the support member 110 includes a spring receiving member 118 (second facing portion).

The spring receiving member 118 is formed of, for example, a metal such as stainless steel, and has a sheet shape. The edge of the spring receiving member 118 is supported on an inner surface a cylindrical lateral portion of the support member 110. The spring receiving member 118 faces the surface of the vibration member 140 which is located on the opposite side to the piezoelectric element 130. The rigidity of the spring receiving member 118 is higher than the rigidity of the vibration member 140. One end of the second spring 154 is attached to the spring receiving member 118. The second interconnect 173 is connected to the spring receiving member 118. That is, in the present embodiment, the second spring 154 is connected to the second interconnect 173 through the spring receiving member 118.

In the present embodiment, it is also possible to obtain the same effect as that of the second embodiment. In addition, even when the existing support member 110 is used, by regulating a position at which the spring receiving member 118 is attached, the lengths of the first spring 152 and the second spring 154 in a state where the piezoelectric element 130 does not vibrate can be made to be equal to each other.

Fourth Embodiment

Figure 7:
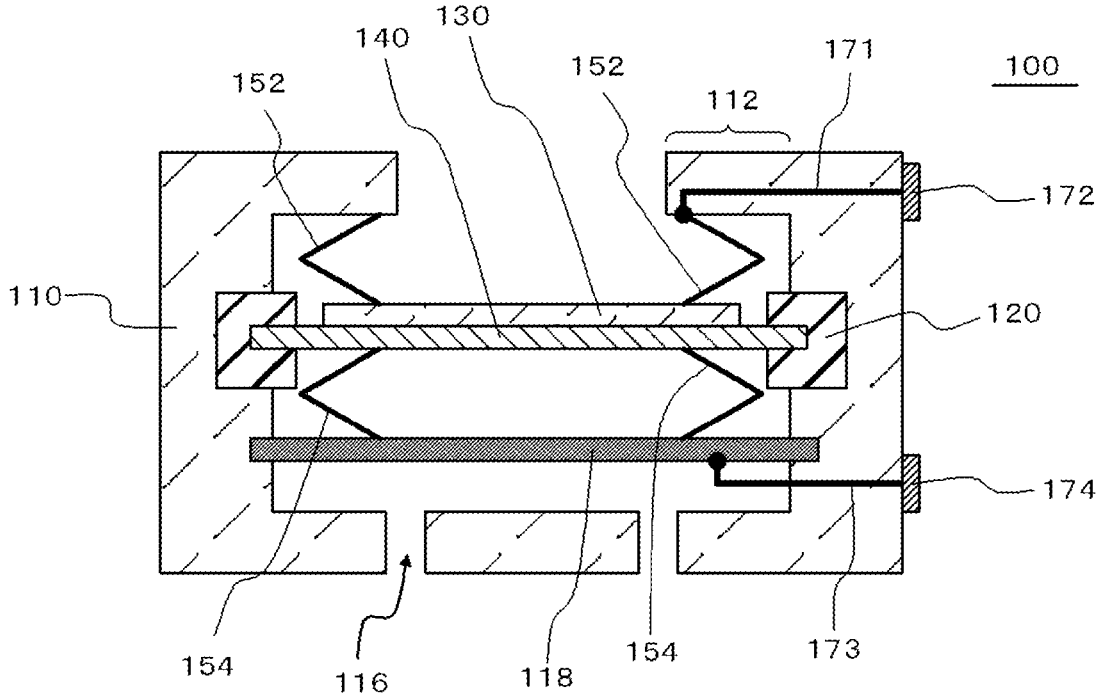
FIG. 7 is a diagram illustrating a configuration of an oscillation device according to a fourth embodiment.

FIG. 7 is a diagram illustrating a configuration of an oscillation device 100 according to a fourth embodiment. The oscillation device 100 according to the present embodiment has the same configuration as that of the oscillation device 100 according to the third embodiment, except that the first spring 152 and the second spring 154 are flat springs (leaf springs).

In the present embodiment, it is also possible to obtain the same effect as that of the third embodiment.

As described above, although the embodiments of the present invention have been set forth with reference to the drawings, these are merely illustrative of the invention, and various configurations other than those stated above can be adopted.

The application claims priority from Japanese Patent Application No. 2011-267826 filed on Dec. 7, 2011, the content of which is incorporated herein by reference in its entirety.

The invention claimed is:

1. An oscillation device comprising:

a sheet-like vibration member;

a piezoelectric element which is attached to one surface of the vibration member;

a support member that supports an edge of the vibration member;

a first facing portion, provided in the support member, which faces the one surface of the vibration member;

a second facing portion, provided in the support member, which faces a surface which is located on the opposite side to the one surface of the vibration member;

a first spring which is provided between the vibration member or the piezoelectric element and the first facing portion; and a second spring which is provided between the vibration member and the second facing portion.

2. The oscillation device according to claim 1, wherein three or more first springs are provided at positions which do not overlap each other when seen in a plan view, and three or more second springs are provided at positions which do not overlap each other when seen in a plan view.

3. The oscillation device according to claim 1, wherein the first spring is provided between the piezoelectric element and the first facing portion.

4. The oscillation device according to claim 3, wherein an electrode is formed on a surface of the piezoelectric element which does not face the vibration member, the first spring is formed of a conductive material, and the oscillation device further includes a first interconnect connected to the first spring.

5. The oscillation device according to claim 1, wherein the vibration member and the second spring are formed of a conductive material, and the oscillation device further includes a second interconnect connected to the second spring.

6. The oscillation device according to claim 1, wherein the first spring and the second spring overlap each other when seen in a plan view.

7. The oscillation device according to claim 6, wherein spring constants of the first spring and the second spring are equal to each other.

8. The oscillation device according to claim 1, wherein both the first spring and the second spring are coil springs or flat springs.

* * * * *